US006929197B2

(12) United States Patent
Peterson, Jr.

(10) Patent No.: US 6,929,197 B2
(45) Date of Patent: Aug. 16, 2005

(54) GENERALLY CIRCULAR SPRAY PATTERN CONTROL WITH NON-ANGLED ORIFICES IN FUEL INJECTION METERING DISC AND METHOD

(75) Inventor: William A. Peterson, Jr., Smithfield, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 107 days.

(21) Appl. No.: 10/253,499

(22) Filed: Sep. 25, 2002

(65) Prior Publication Data

US 2004/0056115 A1 Mar. 25, 2004

(51) Int. Cl.[7] ..... F02M 59/00; F02M 39/00; B05B 1/30

(52) U.S. Cl. ..... 239/533.2; 239/533.3; 239/533.12; 239/533.14; 239/585.1; 239/585.3; 239/585.5

(58) Field of Search ..... 239/533.2, 533.3, 239/533.8, 533.9, 533.12, 533.14, 585.1–585.5, 596, 88–93, 5; 251/129.15, 129.21, 127

(56) References Cited

U.S. PATENT DOCUMENTS

| | | | | |
|---|---|---|---|---|
| 4,057,190 A | | 11/1977 | Kiwior et al. | 239/558 |
| 4,101,074 A | | 7/1978 | Kiwior | 239/585 |
| 4,532,906 A | | 8/1985 | Höppel | 123/470 |
| 4,923,169 A | * | 5/1990 | Grieb et al. | 251/118 |

(Continued)

FOREIGN PATENT DOCUMENTS

| | | |
|---|---|---|
| EP | 1 092 865 A | 4/2001 |
| EP | 1 154 151 | 11/2001 |
| JP | 10-122096 | 12/1998 |
| JP | 2000-097129 | 9/2000 |
| WO | WO 00/52328 | 9/2000 |

OTHER PUBLICATIONS

European Search Report, EP 01 20 1450, Aug. 1, 2001.
PCT/US02/17941 International Search Report, Sep. 25, 2002.

(Continued)

*Primary Examiner*—Davis Hwu

(57) ABSTRACT

Fuel metering components of a fuel injector that allow spray targeting and distribution of fuel to be configured using non-angled or straight orifice having an axis parallel to a longitudinal axis of the fuel metering components. Metering orifices are located about the longitudinal axis and defining a first virtual circle greater than a second virtual circle defined by a projection of the sealing surface onto the metering disc so that all of the metering orifices are disposed outside the second virtual or bolt circle within one quadrant of the circle. A channel is formed between the seat orifice and the metering disc that allows the fuel injector to generate an unified spray pattern along the longitudinal axis that forms a flow area with a plurality of uniform radii on a virtual plane transverse to the longitudinal axis. The fuel injector of the preferred embodiments is therefore insensitive to the angular orientation of the fuel injector or its metering components about a longitudinal axis without resorting to angled metering orifices and yet achieves a desired targeting, distribution and atomization of the fuel injector. A method of generating the flow area with a plurality of uniform radii is also provided.

22 Claims, 7 Drawing Sheets

U.S. PATENT DOCUMENTS

| | | | | | |
|---|---|---|---|---|---|
| 4,925,111 | A | | 5/1990 | Foertsch et al. | 239/533.12 |
| 5,038,738 | A | | 8/1991 | Hafner et al. | 123/470 |
| 5,244,154 | A | * | 9/1993 | Buchholz et al. | 239/590.3 |
| 5,449,114 | A | | 9/1995 | Wells et al. | 239/5 |
| 5,516,047 | A | | 5/1996 | Kubach et al. | 239/585.5 |
| 5,730,368 | A | | 3/1998 | Flik et al. | 239/575 |
| 5,766,441 | A | | 6/1998 | Arndt et al. | 239/596 |
| 5,772,124 | A | | 6/1998 | Tamaki et al. | 239/533.12 |
| 5,785,254 | A | | 7/1998 | Zimmermann et al. | 239/490 |
| 5,862,991 | A | | 1/1999 | Willke et al. | 239/397.5 |
| 5,931,391 | A | | 8/1999 | Tani et al. | 239/533.12 |
| 6,102,299 | A | | 8/2000 | Pace et al. | 239/533.12 |
| 6,170,763 | B1 | * | 1/2001 | Fuchs et al. | 239/533.12 |
| 6,394,367 | B2 | | 5/2002 | Munezane et al. | 239/533.12 |
| 6,405,946 | B1 | | 6/2002 | Harata et al. | 239/533.12 |
| 2002/0063175 | A1 | | 5/2002 | Kitamura et al. | 239/585.1 |

OTHER PUBLICATIONS

U.S. Appl. No. 09/568,464, Injection Valve with Single Disc Turbulence Generation, filed May 10, 2000, Pending.

U.S. Appl. No. 10/097,627, Injection Valve with Single Disc Turbulence Generation, filed Mar. 15, 2002, Pending.

U.S. Appl. No. 10/162,759, Spray Pattern Control with Non–Angled Orifices in Fuel Injection Metering Disc, filed Jun. 6, 2002, Pending.

U.S. Appl. No. 10/183,392, Spray Control with Non–Angled Orifices in Fuel Injection Metering Disc Methods, filed Jun. 28, 2002, Pending.

U.S. Appl. No. 10/183,406, Spray Pattern and Spray Distribution Control with Non–Angled Orifices in Fuel Injection Metering Disc and Methods, filed Jun. 28, 2002, Pending.

U.S. Appl. No. 10/253,467, Spray Targeting to an Arcuate Sector with Non–Angled Orifices in Fuel Injection Metering Disc and Method, filed Jun. 6, 2002, Pending.

U.S. Appl. No. 10/253,468, Spray Pattern Control with Angular Orientation in Fuel Injector and Method, filed Sep. 25, 2002, Pending.

* cited by examiner

FIG. 4A
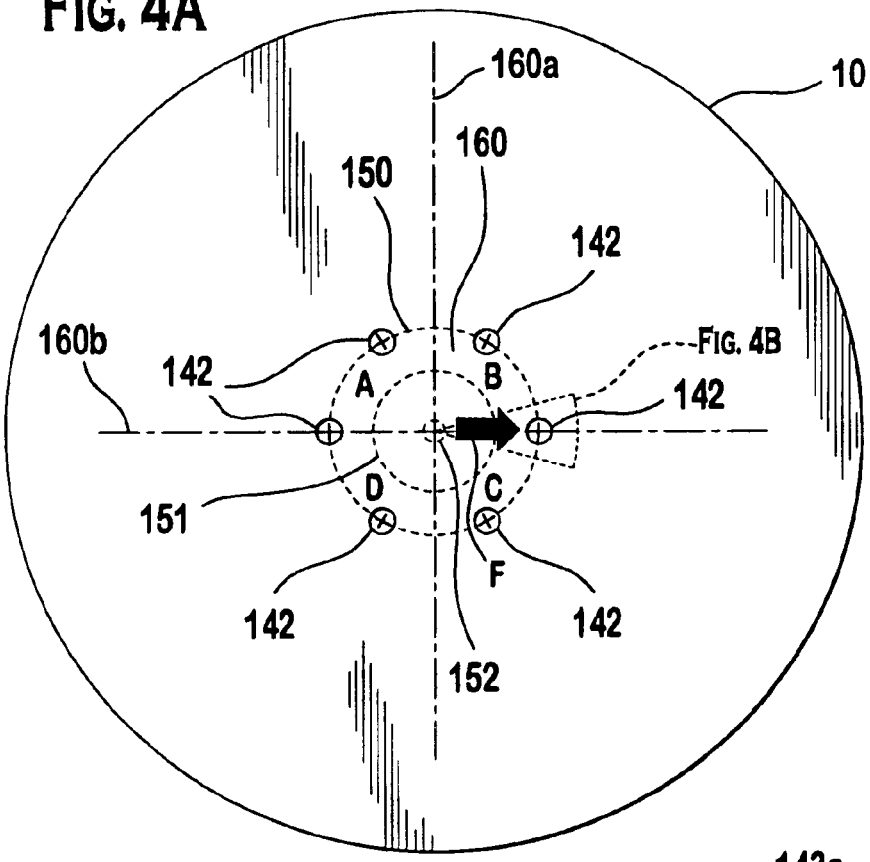
FIG. 4B
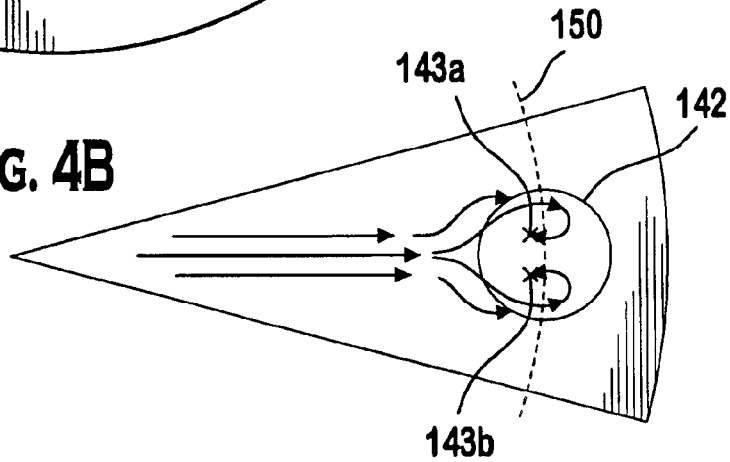
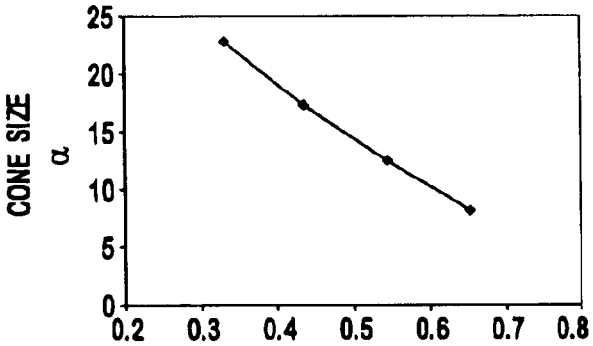
FIG. 5

FIG. 6A
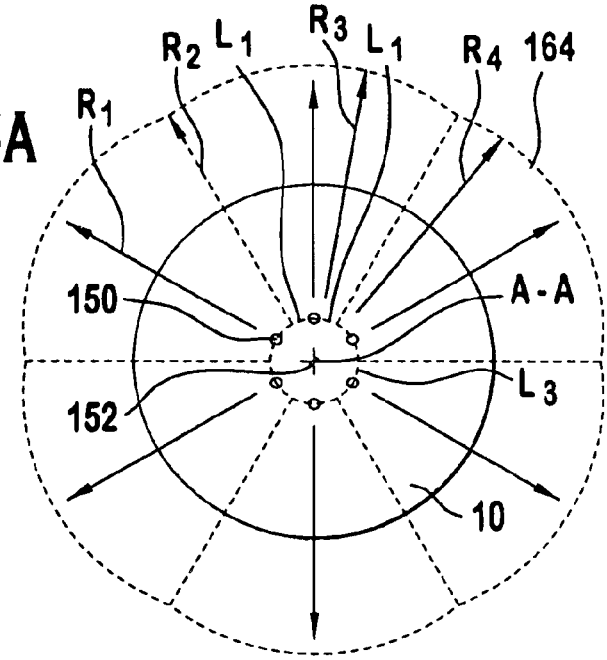
FIG. 6B
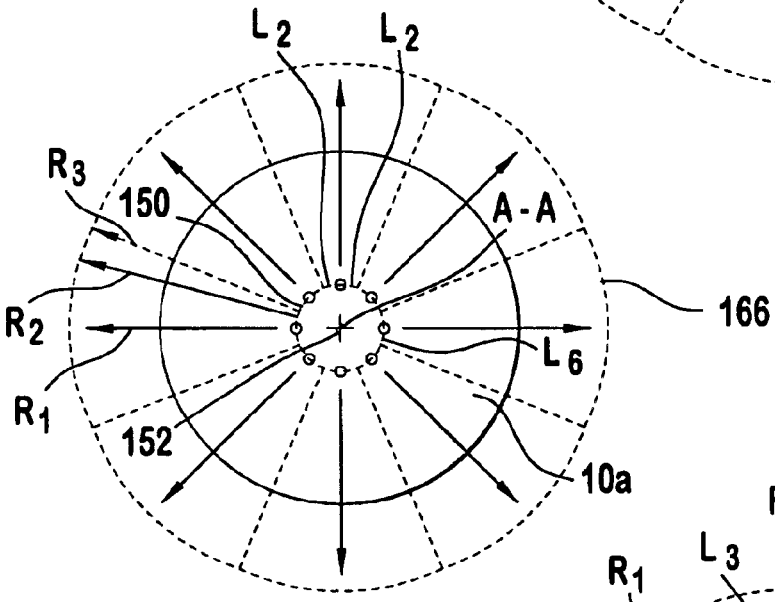
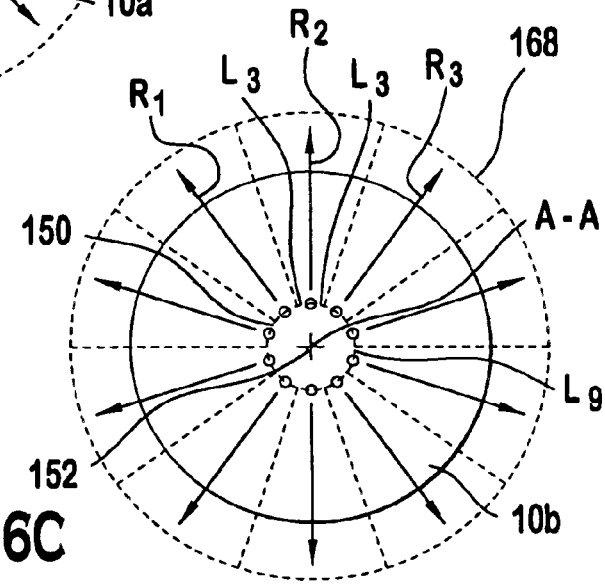
FIG. 6C

GENERALLY CIRCULAR SPRAY PATTERN CONTROL WITH NON-ANGLED ORIFICES IN FUEL INJECTION METERING DISC AND METHOD

BACKGROUND OF THE INVENTION

Most modern automotive fuel systems utilize fuel injectors to provide precise metering of fuel for introduction towards each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electro-magnetic fuel injector typically utilizes a solenoid assembly to supply an actuating force to a fuel metering assembly. Typically, the fuel metering assembly is a plunger-style closure member which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration.

It has been determined that a fuel spray pattern using a circularly arrayed and non-angled metering orifices can lead to a somewhat uneven flow pattern, which can be seen by injecting fuel onto a target area transverse to the longitudinal axis and spaced at a predetermined distance from the fuel injector. That is to say, even though the circular array of metering orifices of such an injector should provide a hypothetically circular and symmetrical flow pattern on the target transverse area, the fuel injector fails to do so due to an interplay between respective concentricities of the array of non-angled metering orifices, a seat orifice of the injector and the longitudinal axis. And in some cases, more fuel is actually delivered to different areas of the hypothetical circular flow area, leading to a formation of "lobes" formed within the hypothetical circular flow area. The formation of lobes in the flow area tends to require costly adjustments to a fuel injector and its mounting arrangement or even specially configured fuel injector that may or may not compensate for the uneven fuel distribution about the hypothetical circular area on the lobes.

It is believed that known metering orifices formed at an angle with respect to a longitudinal axis (i.e., "angled metering orifices") of a fuel injector and arrayed in circular pattern along the longitudinal axis allow greater symmetry and greater latitude in configuring the fuel injector to operate with different engine configuration while achieving an acceptable level of fuel atomization, (quantifiable as an average Sauter-Mean-Diameter (SMD)). It is believed, however, that angled metering orifices require, at the present time, specialized machinery, trained operators and greater inefficiencies to manufacture than non-angled metering orifices.

It would be beneficial to develop a fuel injector in which non-angled metering orifices can be used in controlling spray targeting and spray distribution of fuel. It would also be beneficial to develop a fuel injector in which increased atomization or precise targeting can be changed so as to meet a particular fuel targeting and cone pattern from one type of engine configuration to another type. Furthermore, it would be beneficial to develop a fuel injector in which a circular array of non-angled metering orifices provides a flow area with a plurality of uniform radii about the longitudinal axis on a transverse plane without requiring specialized adjustments or configuration of the fuel injector in order to deliver a symmetrical circular flow area pattern.

SUMMARY OF THE INVENTION

The present invention provides fuel targeting and fuel spray distribution of a fuel injector at an acceptable level of fuel atomization with non-angled metering orifices such that the invention obviates the need to orient metering orifices about a longitudinal axis of the fuel injector. The present invention allows a fuel spray pattern of an injector to approximate a flow area with a plurality of uniform radii downstream of the fuel injector so that regardless of a rotational orientation of the fuel injector about the longitudinal axis, the flow area with a plurality of uniform radii about the longitudinal axis can be achieved. In a preferred embodiment, a fuel injector is provided. The fuel injector includes a housing, a seat, a closure member and a metering disc. The housing has passageway extending between an inlet and an outlet along a longitudinal axis. The seat has a sealing surface facing the inlet and forming a seat orifice with a terminal seat surface spaced from the sealing surface and facing the outlet, and a first channel surface generally oblique to the longitudinal axis and is disposed between the seat orifice and the terminal seat surface. The closure member is disposed in the passageway and contiguous to the sealing surface so as to generally preclude fuel flow through the seat orifice in one position. A magnetic actuator is disposed proximate the closure member so that, when energized, the actuator positions the closure member away from the sealing surface of the seat so as to allow fuel flow through the passageway and past the closure member. The metering disc is proximate to the seat and includes a second channel surface confronting the first channel surface so as to form a flow channel. The metering disc has at least two metering orifices located outside of the first virtual circle. The at least two metering orifices being located about the longitudinal axis at substantially equal arcuate distance apart between adjacent metering orifices. Each metering orifice extends generally parallel to the longitudinal axis between the second channel surface and a third surface spaced from the second channel surface so that when the closure member is in the actuated position, a flow of fuel through the metering orifices generates an unified spray pattern along the longitudinal axis that intersects a virtual plane orthogonal to the longitudinal axis to define a flow area of generally uniform radii about the longitudinal axis.

In yet another aspect of the present invention, a method of generating a unified spray pattern with a flow area of generally uniform radii about a longitudinal axis is provided. The fuel injector includes a passageway extending between an inlet and outlet along a longitudinal axis, a seat and a metering disc. The seat has a sealing surface facing the inlet and forming a seat orifice. The seat has a terminal seat surface spaced from the sealing surface and facing the outlet, and a first channel surface generally oblique to the longitudinal axis and disposed between the seat orifice and the terminal seat surface. The closure member is disposed in the passageway and contiguous to the sealing surface so as to generally preclude fuel flow through the seat orifice in one position. A magnetic actuator is disposed proximate the closure member so that, when energized, the actuator positions the closure member away from the sealing surface of the seat so as to allow fuel flow through the passageway and past the closure member. The metering disc has at least two metering orifices. Each metering orifice extends between second and outer surfaces along the longitudinal axis with the second surface facing the first channel surface. The method can be achieved, in part, by locating the at least two metering orifices outside of the first virtual circle, the metering orifices extending generally parallel to the longitudinal axis through the second and outer surfaces of the metering disc; and flowing fuel through the at least two metering orifices upon actuation of the fuel injector so that a fuel flow path intersecting a virtual plane orthogonal to the longitudinal axis defines a flow area of generally uniform radii about the longitudinal axis on the virtual plane.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

FIGS. 2B and 2C illustrate two close-up views of two preferred embodiments of the fuel metering components that, in particular, show the various relationships between various components in the fuel metering components.

FIG. 4 illustrates a preferred embodiment of the metering disc arranged on a bolt circle.

FIG. 5 illustrates a relationship between a ratio t/D of each metering orifice with respect to spray cone size for a specific configuration of the fuel injector.

FIGS. 6A, 6B, and 6C illustrate how the shape of the flow area approximates that of a circle with increased number of metering orifices with attendant decrease in an included angle of the generally unified spray pattern.

Figure 7A:
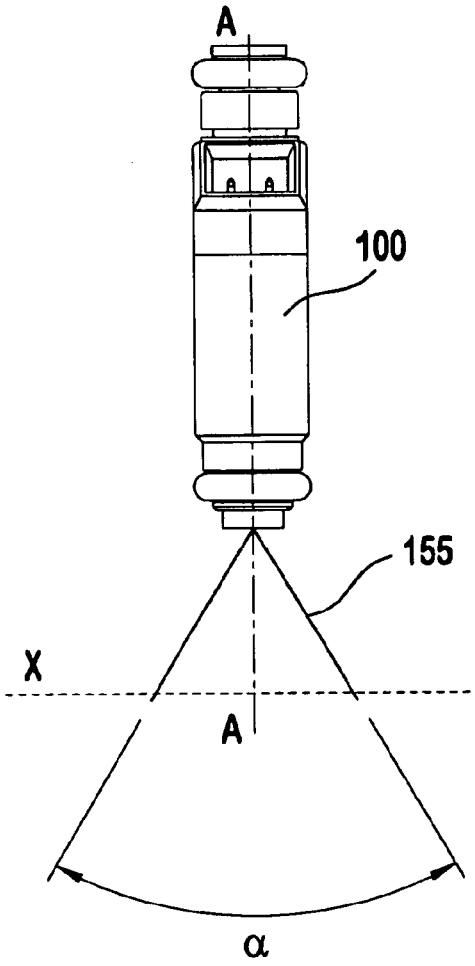
Figure 7B:
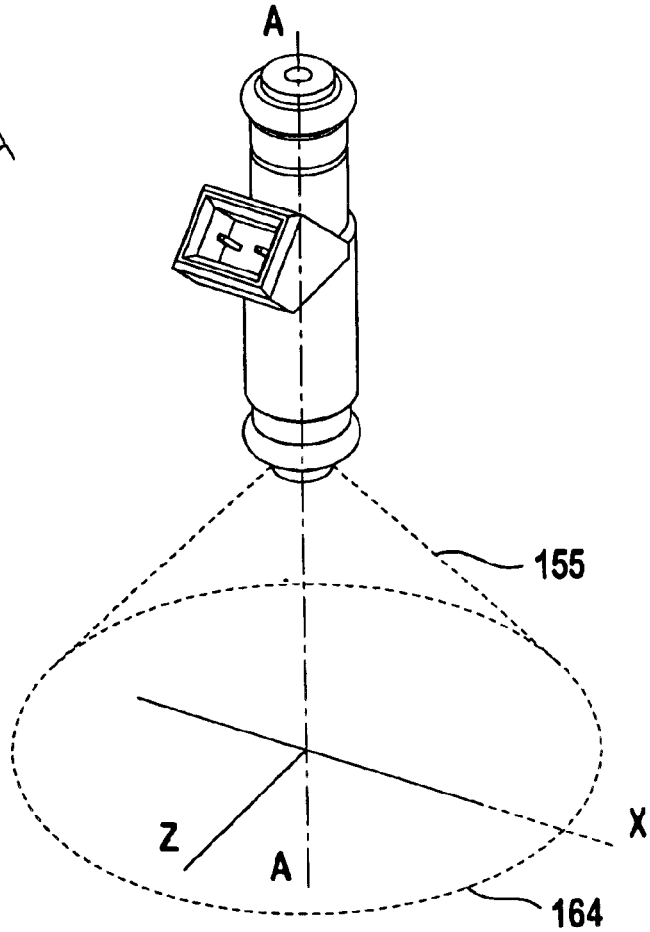

FIGS. 7A and 7B illustrate the fuel injector with a unified spray pattern generated during actuation of a preferred embodiment of the fuel injector.

DETAILED DESCRIPTION OF THE PREFERRED EMBODIMENTS

Figure 1:
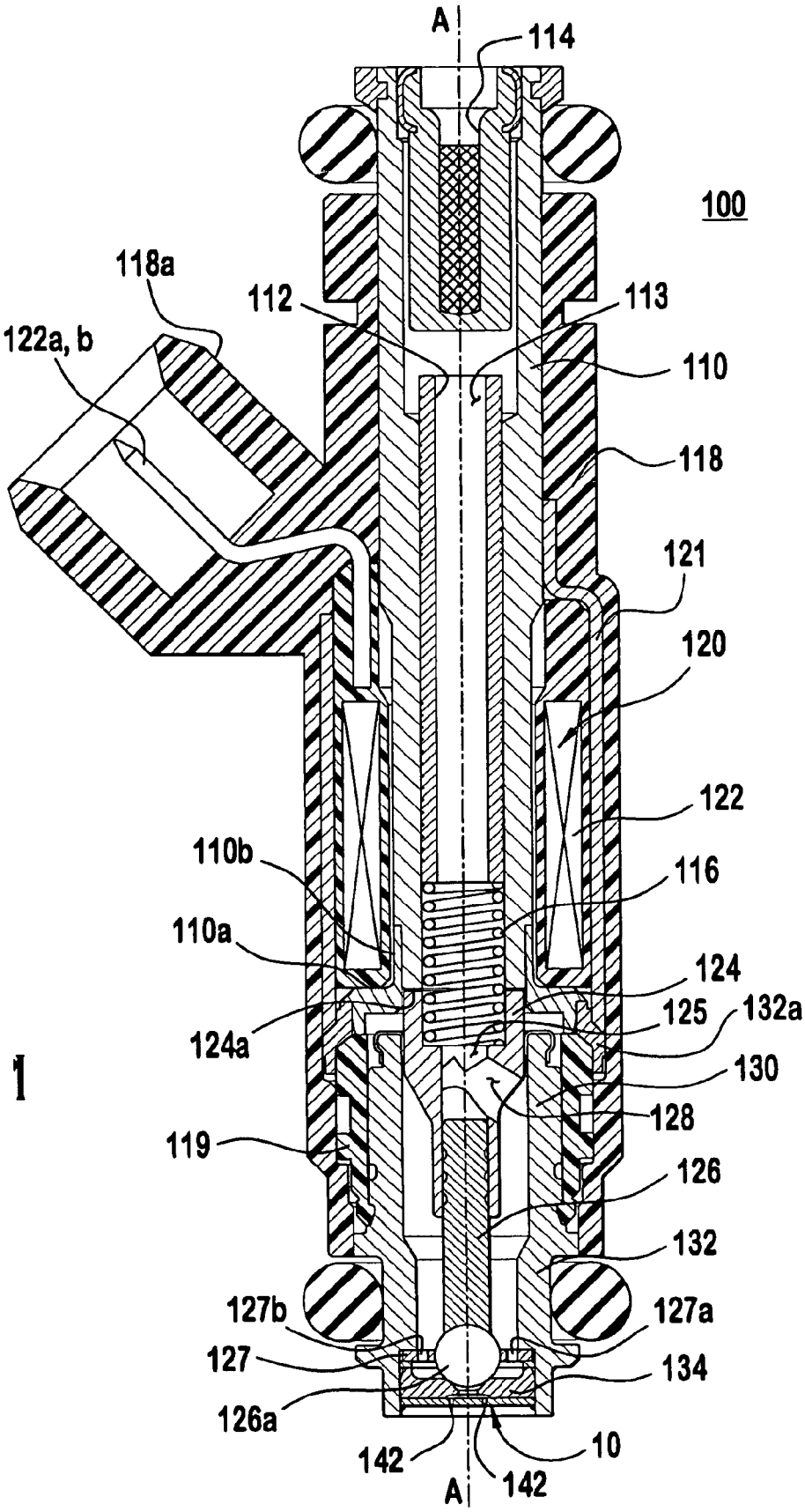
FIG. 1 illustrates a preferred embodiment of the fuel injector.

FIGS. 1–7 illustrate the preferred embodiments. In particular, a fuel injector 100 having a preferred embodiment of the metering disc 10 is illustrated in FIG. 1. The fuel injector 100 includes: a fuel inlet tube 110, an adjustment tube 112, a filter assembly 114, a coil assembly 118, a coil spring 116, an armature 124, a closure member 126, a non-magnetic shell 110*a*, a first overmold 118, a body 132, a body shell 132*a*, a second overmold 119, a coil assembly housing 121, a guide member 127 for the closure member 126, a seat 134, and a metering disc 10.

The guide member 127, the seat 134, and the metering disc 10 form a stack that is coupled at the outlet end of fuel injector 100 by a suitable coupling technique, such as, for example, crimping, welding, bonding or riveting. Armature 124 and the closure member 126 are joined together to form an armature/closure member assembly. It should be noted that one skilled in the art could form the assembly from a single component. Coil assembly 120 includes a plastic bobbin on which an electromagnetic coil 122 is wound.

Respective terminations of coil 122 connect to respective terminals 122*a*, 122*b* that are shaped and, in cooperation with a surround 118*a* formed as an integral part of overmold 118, to form an electrical connector for connecting the fuel injector to an electronic control circuit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the armature/closure member such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload spring 116. Armature 124 includes a passageway 128 that communicates volume 125 with a passageway 113 in body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 110*a* has a tubular neck that telescopes over a tubular neck at the lower end of fuel inlet tube 110. Shell 110*a* also has a shoulder that extends radially outwardly from neck. Body shell 132*a* can be ferromagnetic and can be joined in fluid-tight manner to non-ferromagnetic shell 110*a*, preferably also by a hermetic laser weld.

The upper end of body 130 fits closely inside the lower end of body shell 132*a* and these two parts are joined together in fluid-tight manner, preferably by laser welding. Armature 124 can be guided by the inside wall of body 130 for axial reciprocation. Further axial guidance of the armature/closure member assembly can be provided by a central guide hole in member 127 through which closure member 126 passes.

Prior to a discussion of fuel metering components proximate the outlet end of the fuel injector 100, it should be noted that the preferred embodiments of a seat and metering disc of the fuel injector 100 allow for a targeting of the fuel spray pattern (i.e., fuel spray separation) to be selected without relying on angled orifices. Moreover, the preferred embodiments allow the cone pattern (i.e., a narrow or large divergent cone spray pattern) to be selected based on the preferred spatial orientation of inner wall surfaces of the metering orifices being parallel to the longitudinal axis (i.e. so that the longitudinal axis of the wall surfaces is parallel to the longitudinal axis).

Figure 2A:
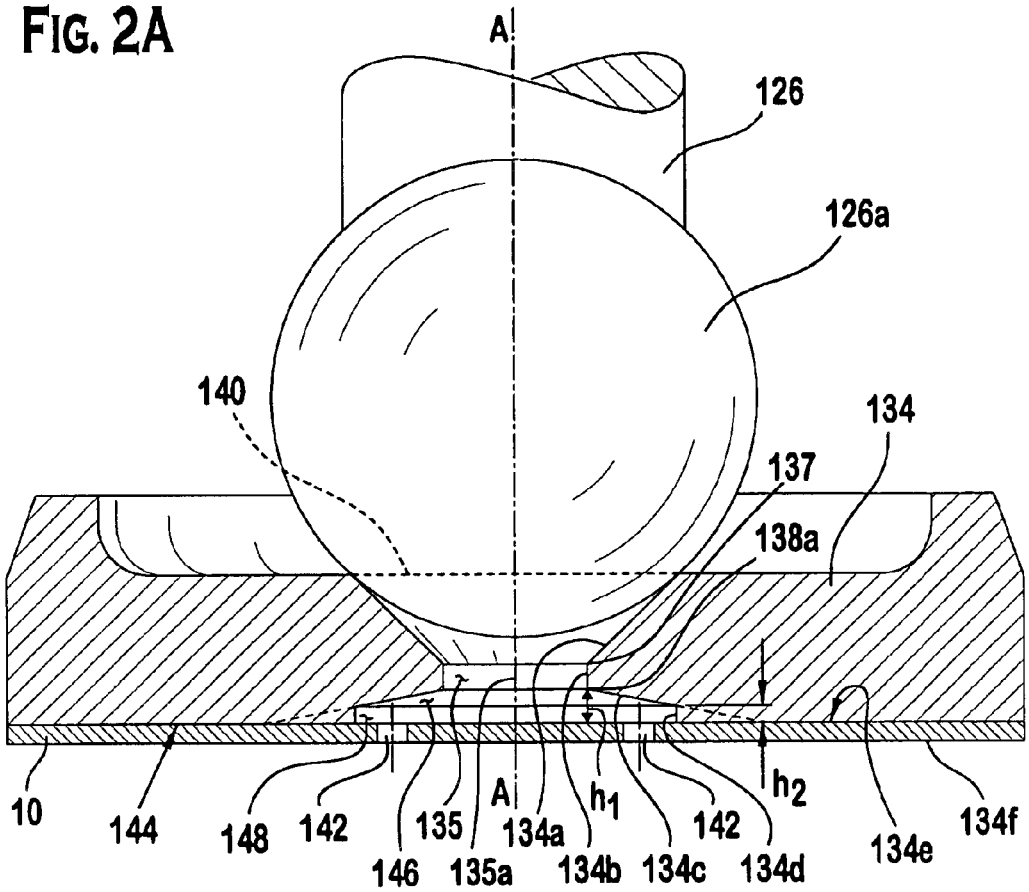
FIG. 2A illustrates a close-up cross-sectional view of an outlet end of the fuel injector of FIG. 1.

Referring to a close up illustration of the fuel metering components of the fuel injector in FIG. 2A which has a closure member 126, seat 134, and a metering disc 10. The closure member 126 includes a spherical surface shaped member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A—A. The seal can be defined as a sealing circle 140 formed by contiguous engagement of the spherical member 126*a* with the seat surface 134*a*, shown here in FIGS. 2A and 3. The seat 134 includes a seat orifice 135, which extends generally along the longitudinal axis A—A of the metering disc and is formed by a generally cylindrical wall 134*b*. Preferably, a center 135*a* of the seat orifice 135 is located generally on the longitudinal axis A—A. As used herein, the terms "upstream" and "downstream" denote that fuel flow generally in one direction from inlet through the outlet of the fuel injector while the terms "inward" and "outward" refer to directions toward and away from, respectively, the longitudinal axis A—A. And the longitudinal axis A—A is defined as the longitudinal axis of the metering disc, which in the preferred embodiments, is coincident with a longitudinal axis of the fuel injector.

Downstream of the circular wall 134*b*, the seat 134 tapers along a portion 134*c* towards a first metering disc surface 134*e*, which is spaced at a thickness "t" from a second metering disc surface or outer surface 134*f*. The taper of the portion 134*c* preferably can be linear or curvilinear with respect to the longitudinal axis A—A, such as, for example, a linear taper 134 (FIG. 2B) or a curvilinear taper 134*c*' that forms an compound curved dome (FIG. 2C).

In one preferred embodiment, the taper of the portion 134*c* is generally linearly tapered (FIG. 2B) in a downward and outward direction at a taper angle β away from the seat orifice 135 to a point radially past at least one metering orifice 142. At this point, the seat 134 extends along and is preferably parallel to the longitudinal axis so as to preferably form cylindrical wall surface 134*d*. The wall surface 134*d* extends downward and subsequently extends in a generally radial direction to form a bottom surface 134*e*, which is preferably perpendicular to the longitudinal axis A—A. Alternatively, the portion 134*c* can extend through to the surface 134*e* of the seat 134. Preferably, the taper angle β is about 10 degrees relative to a plane transverse to the longitudinal axis A—A. In another preferred embodiment, as shown in FIG. 2C, the taper is a second-order curvilinear taper 134*c*' which is suitable for applications that may require tighter control on the constant velocity of fuel flow. Generally, however, the linear taper 134*c* is believed to be suitable for its intended purpose in the preferred embodiments.

The interior face 144 of the metering disc 10 proximate to the outer perimeter of the metering disc 10 engages the bottom surface 134*e* along a generally annular contact area. The seat orifice 135 is preferably located wholly within the perimeter, i.e., a "bolt circle" 150 defined by an imaginary line connecting a center of each of at least two metering orifices 142 symmetrical about the longitudinal axis. That is, a virtual extension of the surface of the seat 135 generates a virtual orifice circle 151 (FIG. 4A) preferably disposed within the bolt circle 150 of metering orifices disposed at equal arcuate distance between adjacent metering orifices.

Figure 2B:
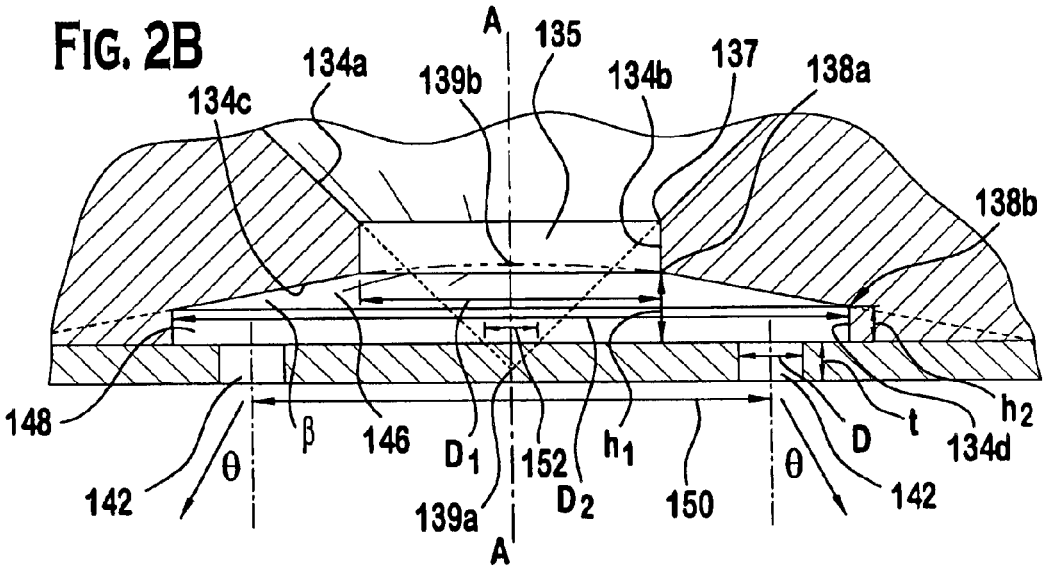
FIG. 2B illustrates a further close-up view of the preferred embodiment of the fuel metering components that, in particular, show the various relationships between various components in the subassembly.
Figure 2C:
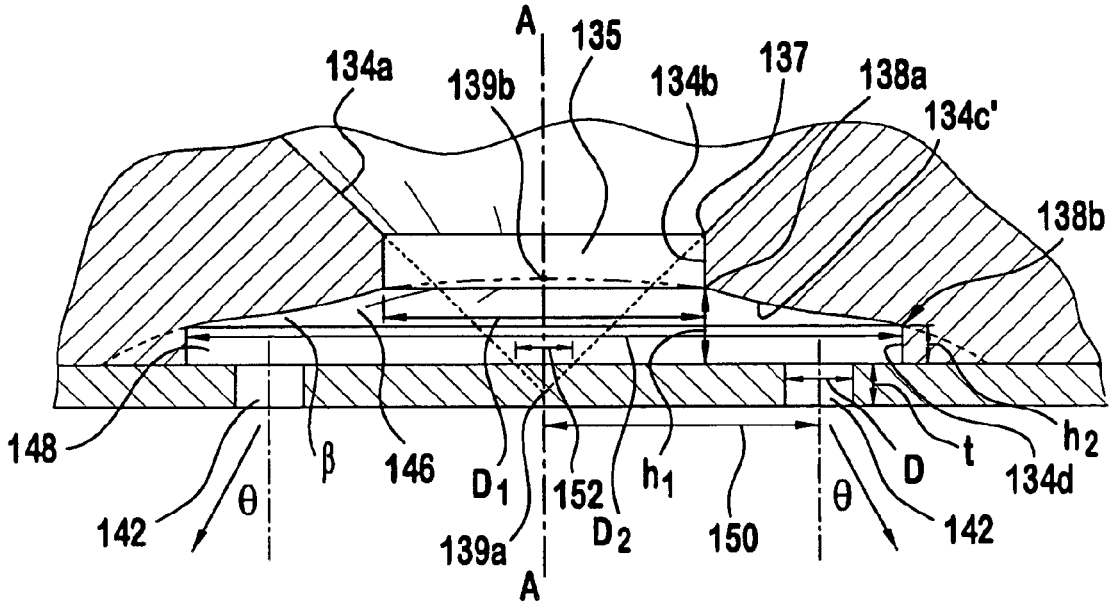

The cross-sectional virtual extensions of the taper of the seat surface 134*b* converge upon the metering disc so as to generate a virtual circle 152 (FIGS. 2B and 4). Furthermore, the virtual extensions converge to an apex 139*a* located within the cross-section of the metering disc 10. In one preferred embodiment, the virtual circle 152 of the seat surface 134*b* is located within the bolt circle 150 of the metering orifices. The bolt circle 150 is preferably entirely outside the virtual circle 152. It is preferable that all of the at least one metering orifice 142 are outside the virtual circle 152 such that an edge of each metering orifice can be on part of the boundary of the virtual circle but without being inside of the virtual circle. Preferably, the at least two metering orifices 142 include six to ten metering orifices equally spaced about the longitudinal axis.

A generally annular controlled velocity channel 146 is formed between the seat orifice 135 of the seat 134 and interior face 144 of the metering disc 10, illustrated here in FIG. 2A. Specifically, the channel 146 is initially formed at an inner edge 138*a* between the preferably cylindrical surface 134*b* and the preferably linearly tapered surface 134*c*, which channel terminates at an outer edge 138*b* proximate the preferably cylindrical surface 134*d* and the terminal surface 134*e*. As viewed in FIGS. 2B and 2C, the channel changes in cross-sectional area as the channel extends outwardly from the inner edge 138*a* proximate the seat to the outer edge 138*b* outward of the at least one metering orifice 142 such that fuel flow is imparted with a radial velocity between the orifice and the at least one metering orifice.

Figure 3:
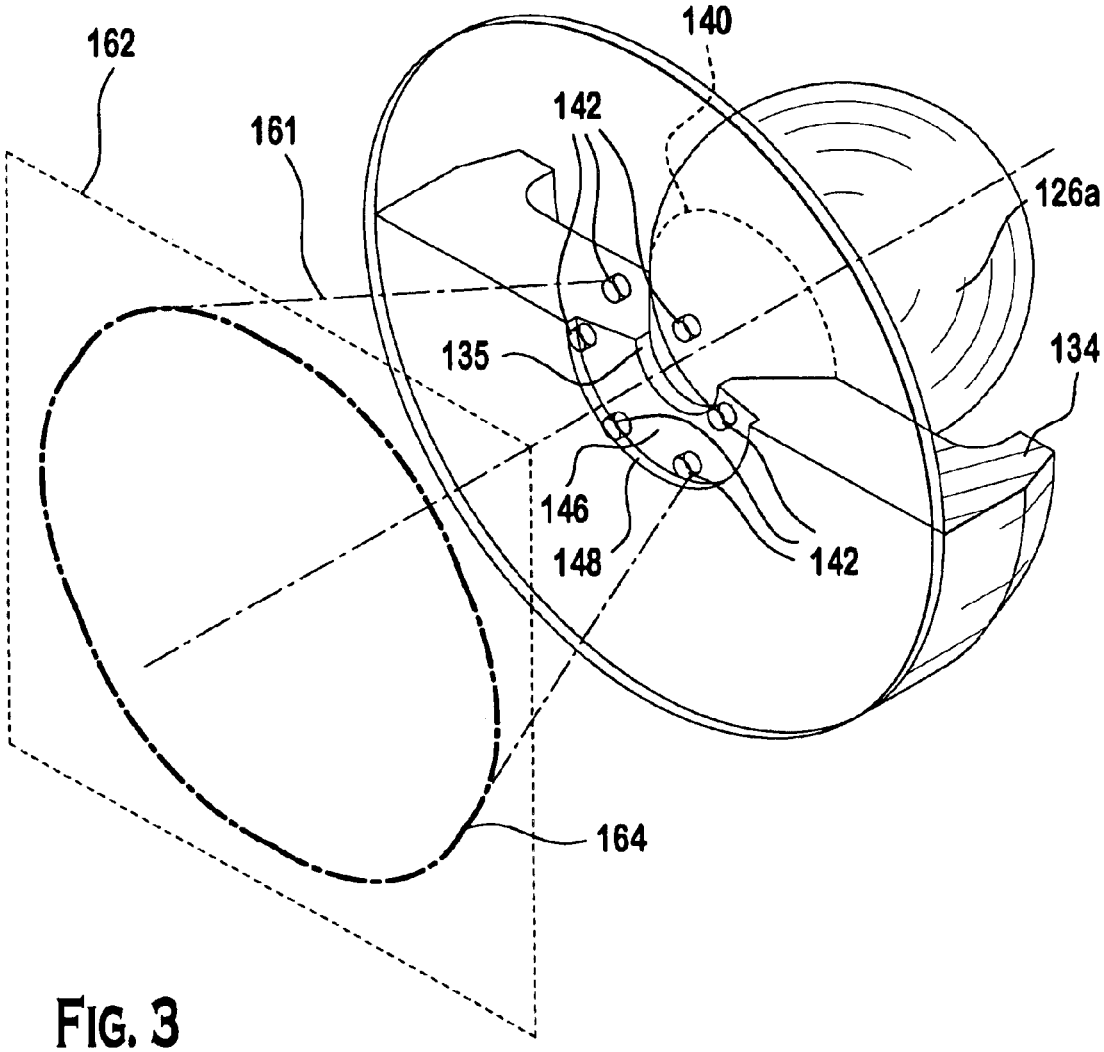
FIG. 3 illustrates a perspective view of outlet end of the fuel injector of FIG. 2A that forms a generally circular cross-section as the fuel spray intersects a virtual plane orthogonal to the longitudinal axis.

That is to say, a physical representation of a particular relationship has been discovered that allows the controlled velocity channel 146 to provide a constant velocity to fluid flowing through the channel 146. In this relationship, the channel 146 tapers outwardly from a first cylindrical area defined by the product of the pi-constant (π), a larger height $h_1$ with corresponding radial distance $D_1$ to a substantially equal second cylindrical area defined by the product of the pi-constant ($\pi$), a smaller height $h_2$ with correspondingly larger radial distance $D_2$. Preferably, a product of the height $h_1$, distance $D_1$ and $\pi$ is approximately equal to the product of the height $h_2$, distance $D_2$ and $\pi$ (i.e. $D_1*h_1*\pi=D_2*h_2*\pi$ or $D_1*h_1=D_2*h_2$) formed by a taper, which can be linear or curvilinear. The distance $h_2$ is believed to be related to the taper in that the greater the height $h_2$, the greater the taper angle $\beta$ is required and the smaller the height $h_2$, the smaller the taper angle $\beta$ is required. An annular space 148, preferably cylindrical in shape with a length $D_2$, is formed between the preferably linear wall surface 134*d* and an interior face of the metering disc 10. And as shown in FIGS. 2A and 3, a frustum is formed by the controlled velocity channel 146 downstream of the seat orifice 135, which frustum is contiguous to preferably a right-angled cylinder formed by the annular space 148.

In another preferred embodiment, the cylinder of the annular space 148 is not used and instead a frustum forming part of the controlled velocity channel 146 is formed. That is, the channel surface 134*c* extends all the way to the surface 134*e* contiguous to the metering disc 10, and referenced in FIGS. 2B and 2C as dashed lines. In this embodiment, the height $h_2$ can be referenced by extending the distance $D_2$ from the longitudinal axis A—A to a desired point transverse thereto and measuring the height $h_2$ between the metering disc 10 and the desired point of the distance $D_2$. It is believed that the channel surface in this embodiment has a tendency to increase a sac volume of the seat, which may be undesirable in various fuel injector applications. Preferably the desired distance $D_2$ can be defined by an intersection of a transverse plane intersecting the channel surface 134*c* or 134*c*' at a location at least 25 microns outward of the radially outermost perimeter of each metering orifice 142.

By providing a constant velocity of fuel flowing through the controlled velocity channel 146, it is believed that a sensitivity of the position of the at least two metering orifices 142 relative to the seat orifice or the longitudinal axis in spray targeting and spray distribution is minimized. That is to say, due to manufacturing tolerances, acceptable level concentricity of the array of metering orifices 142 relative to the seat orifice 135 or the longitudinal axis may be difficult to achieve. As such, features of the preferred embodiment are believed to provide a metering disc for a fuel injector that is believed to be less sensitive to concentricity variations between the array of metering orifices 142 on the bolt circle 150 and the seat orifice 135 and yet allows for a flow area with a plurality of uniform radii regardless of the rotational position of the fuel injector about the longitudinal axis. Further, it has been determined in a laboratory environment, as compared with known fuel injectors using non-angled orifices with the same operating parameters (e.g., fuel pressure, fuel type, ambient and fuel temperatures) but without configuration of the preferred embodiments, the fuel injectors of the preferred embodiment have achieved desired spray targeting and distribution of fuel while obtaining generally between 10 to 15 percent better atomization of fuel (via measurements of Sauter-Mean-Diameter) for the fuel spray of the fuel injectors of the preferred embodiments. Moreover, not only have the goals of atomization, targeting, distributing and insensitivity to rotational orientation been achieved, the metering components can be manufactured using proven techniques such as, for example, punching, casting, stamping, coining and welding without resorting to specialized machinery, operators or techniques.

Figure 2D:
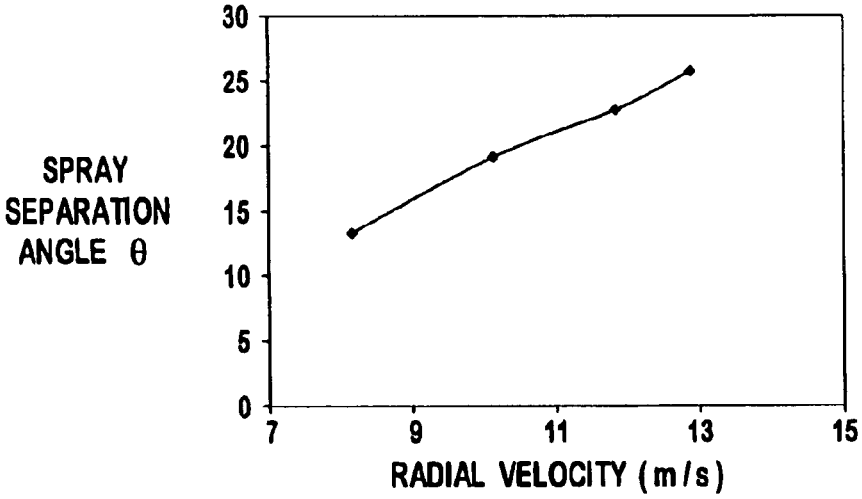
FIG. 2D illustrates a generally linear relationship between spray separation angle of fuel spray exiting the metering orifice to a radial velocity component of the fuel metering components.

By imparting a radial velocity component to fuel flowing through the seat orifice 135, it has been discovered that a spray separation angle $\theta$ of each metering orifice (as referenced to the longitudinal axis) and cone size $\alpha$ of a combined spray pattern through the at least two metering orifices (delineated here as an included angle $\alpha$ of a single cone in FIG. 7A) can be changed as a generally linear function of the radial velocity in FIG. 2D. That is, an increase in a radial velocity component of the fuel flowing through the channel will result in an increase in a spray separation angle $\theta$, and a decrease in the radial velocity component of the fuel flow through channel will result in a decrease in the spray separation angle $\theta$. For example, in a preferred embodiment shown here in FIG. 2D, by changing a radial velocity component of the fuel flowing (between the orifice 135 and the at least two metering orifices 142 through the controlled velocity channel 146) from approximately 8 meter-per-second to approximately 13 meter-per-second, the spray separation angle $\theta$ changes correspondingly from approximately 13 degrees to approximately 26 degrees. The radial velocity can be changed preferably by changing the configuration of the fuel metering components (including $D_1$, $h_1$, $D_2$ or $h_2$ of the controlled velocity channel 146), changing the flow rate of the fuel injector, or by a combination of both. It should be noted that a unified spray pattern is generated by an aggregate combination of each spray pattern of each metering orifice of the at least two metering orifices.

Further, it has been discovered that not only is the flow at a generally constant velocity through a preferred configuration of the controlled velocity channel 146 so as to diverge at a separation angle $\theta$ as a function of the radial velocity component of the fuel flow (FIG. 2D), it has been discovered that the flow through the metering orifices 142 tends to generate at least two vortices within the metering orifices. The at least two vortices generated in the metering orifice can be confirmed by modeling a preferred configuration of the fuel metering components via Computational-Fluid-Dynamics, which is believed to be representative of the true nature of fluid flow through the metering orifice. For example, as shown in FIG. 4B, flow lines flowing radially outward from the seat orifice 135 tend to be generally curved inwardly proximate the orifice 142*a* so as to form at least two vortices 143*a* and 143*b* within a perimeter of the metering orifice 142*a*, which is believed to enhance spray atomization of the fuel flow exiting each of the metering orifices 142. Furthermore, as illustrated in FIG. 3, by providing at least two metering orifices, fuel flow through the metering disc forms a single cone pattern 161 that intersects a virtual plane 162 orthogonal to the longitudinal axis A—A so as to form a flow area 164 with a plurality of uniform radii. The flow area 164 with a plurality of uniform radii is also generally symmetrical about the longitudinal axis A—A (FIGS. 6A–C and 7A–7B).

Moreover, it has also been discovered that the cone size $\alpha$ of the fuel spray is related to the aspect ratio t/D, where "t" is equal to a through length of the orifice and "D" is the largest diametrical distance between the inner surface of the orifice. The ratio t/D can be varied from 0.3 to 1.0 or greater. As the aspect ratio increases or decreases, the cone size becomes narrower or wider correspondingly. Where the distance D is held constant, the larger the thickness "t", the narrower the cone size. Conversely, where the thickness "t" is smaller with the distance D held constant, the cone size $\theta$ is wider. In particular, the cone size $\alpha$ is generally linearly and inversely related to the aspect ratio t/D, shown here in FIG. 5 of a preferred embodiment. Here, as the ratio changes from approximately 0.3 to approximately 0.8, the cone size $\alpha$ generally changes linearly and inversely from approximately 22 degrees to approximately 8 degrees. Hence, it is believed that cone size α (which is approximately twice the spray separation angle θ) can be accomplished by configuring either the velocity channel 146 and space 148, as discussed earlier or the aspect ratio t/D while the symmetry of the flow area 164 can be configured by the number of metering orifices equally spaced about the longitudinal axis. Although the through-length "t" (i.e., the length of the metering orifice along the longitudinal axis A—A) is shown in FIG. 2B as being substantially the same as that of the thickness of the metering disc 10, it is noted that the thickness of the metering disc can be different from the through-length "t" of the metering orifice 142.

The metering disc 10 has at least two metering orifices 142. Each metering orifice 142 has a center located on an imaginary "bolt circle" 150 shown here in FIG. 4. For clarity, each metering orifice is labeled as 142*a*, 142*b*, 142*c* . . . and so on in FIGS. 3 and 4A. Although each metering orifice 142 is preferably circular so that the distance D is generally the same as the diameter of the circular orifice (i.e., between diametrical inner surfaces of the circular opening), other orifice configurations, such as, for examples, square, rectangular, arcuate or slots can also be used. The metering orifices 142 are arrayed in a preferably circular configuration, which configuration, in one preferred embodiment, can be generally concentric with the virtual circle 152. A seat orifice virtual circle 151 (FIG. 4A) is formed by a virtual projection of the orifice 135 onto the metering disc such that the seat orifice virtual circle 151 is outside of the virtual circle 152 and preferably generally concentric to both the first and second virtual or bolt circle 150. The preferred configuration of the metering orifices 142 and the channel allows a flow path "F" of fuel extending radially from the orifice 135 of the seat in any one radial direction away from the longitudinal axis towards the metering disc passes to one metering orifice.

In addition to spray targeting with adjustment of the radial velocity and cone size determination by the controlled velocity channel and the aspect ratio t/D, respectively, a spatial orientation of the non-angled orifice openings 142 can also be used to shape the pattern of the fuel spray by changing the arcuate distance "L" between the metering orifices 142 along a bolt circle 150 in another preferred embodiment. FIGS. 6A–6C illustrate the effect of arraying the metering orifices 142 on progressively smaller equal arcuate distances between adjacent metering orifices 142 so as to achieve an acceptable symmetry of the flow area 164 with corresponding decreases in the cone size. This effect can be seen starting with metering disc 10 and moving through metering discs 10*a* and 10*b*.

In FIG. 6A, relatively large equal arcuate distances $L_1$ between the metering orifices relative to each other form a wide cone pattern. The cone pattern of the fuel spray intersects a virtual plane (orthogonal to the longitudinal axis) to define a flow area with a plurality of generally uniform radii about the longitudinal axis. The flow area 164 has a plurality of radii $R_1$, $R_2$, $R_3$ and so on extending from the longitudinal axis that are generally uniform in magnitude. In FIG. 6B, spacing the metering orifices 142 at a smaller equal arcuate distance $L_2$ than the arcuate distances $L_1$ in FIG. 6A forms a relatively narrower cone pattern. In FIG. 6C, spacing the metering orifices 142 at even smaller equal arcuate distances $L_3$ between each metering orifice 142 forms an even narrower cone pattern. It is noted that each of the flow areas has a plurality of generally uniform radii $R_1$, $R_2$, $R_3$ and so on such that the flow area defined by the radii approaches a suitable cross-sectional shape that allows the injector to be installed in its operative configuration regardless of the angular orientation of the fuel injector about its longitudinal axis. Preferably, the term "generally uniform" indicates that the magnitude of any one radius varies with respect to any other radius by up to ±20% in magnitude. In a most preferred embodiment, the radii would be constant without variation and therefore the shape of the flow area would approach a circular cross-sectional area. It should also be noted that a arcuate distance can be a linear distance between closest inner wall surfaces or edges of respective adjacent metering orifices on the bolt circle 151. Preferably, the linear distance is greater than or equal to the thickness "t" of the metering disc.

The adjustment of arcuate distances can also be used in conjunction with the process previously described so as to tailor the spray geometry (narrower spray pattern with greater spray angle to wider spray pattern but at a smaller spray angle by) of a fuel injector to a specific engine design using non-angled metering orifices (i.e. openings having a generally straight bore generally parallel to the longitudinal axis A—A) while permitting the fuel injector of the preferred embodiments to be insensitive to its angular orientation about the longitudinal axis.

In operation, the fuel injector 100 is initially at the non-injecting position shown in FIG. 1. In this position, a working gap exists between the annular end face 110*b* of fuel inlet tube 110 and the confronting annular end face 124*a* of armature 124. Coil housing 121 and tube 12 are in contact at 74 and constitute a stator structure that is associated with coil assembly 18. Non-ferromagnetic shell 110*a* assures that when electromagnetic coil 122 is energized, the magnetic flux will follow a path that includes armature 124. Starting at the lower axial end of housing 34, where it is joined with body shell 132*a* by a hermetic laser weld, the magnetic circuit extends through body shell 132*a*, body 130 and eyelet to armature 124, and from armature 124 across working gap 72 to inlet tube 110, and back to housing 121.

When electromagnetic coil 122 is energized, the spring force on armature 124 can be overcome and the armature is attracted toward inlet tube 110, reducing working gap 72. This unseats closure member 126 from seat 134 open the fuel injector so that pressurized fuel in the body 132 flows through the seat orifice and through orifices formed on the metering disc 10. It should be noted here that the actuator may be mounted such that a portion of the actuator can disposed in the fuel injector and a portion can be disposed outside the fuel injector. When the coil ceases to be energized, preload spring 116 pushes the closure member closed on seat 134.

As described, the preferred embodiments, including the techniques or method of generating a single cone, are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in Published U.S. Patent Application No. 2002/0047054 A1, published on Apr. 25, 2002, which is pending, and wherein both of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel injector comprising:

a housing having a passageway extending between an inlet and an outlet along a longitudinal axis;

a seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface to face towards the outlet;

a closure member disposed in the passageway and contiguous to the sealing surface so as to generally preclude fuel flow through the seat orifice;

a magnetic actuator proximate the closure member that positions the closure member away from the sealing surface of the seat when energized so as to allow fuel flow through the passageway and past the closure member; and a metering disc proximate the seat so that a virtual projection of the sealing surface onto the metering disc defines a first virtual circle about the longitudinal axis, the metering disc including a second channel surface confronting the first channel surface so as to form a flow channel, the metering disc having at least two metering orifices being located about the longitudinal axis at substantially equal arcuate distance apart between adjacent metering orifices, all of the metering orifices being located outside the first virtual circle, each of the metering orifices extending generally parallel to the longitudinal axis between the second channel surface and an outer surface of the metering disc so that, when the magnetic actuator is energized to move the closure member, a flow of fuel through the metering orifices generates an unified spray pattern that intersects a virtual plane orthogonal to the longitudinal axis to define a flow area of generally uniform radii about the longitudinal axis on the virtual plane.

2. The fuel injector of claim 1, wherein the at least two metering orifices comprise six generally circular metering orifices being located on a second virtual circle outside the first virtual circle and generally concentric to the first virtual circle.

3. The fuel injector of claim 1, wherein the at least two metering orifices comprise eight generally circular metering orifices being located on a second virtual circle outside the first virtual circle and generally concentric to the first virtual circle.

4. A fuel injector, comprising:

a housing having a passageway extending between an inlet and an outlet along a longitudinal axis;

a seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface;

a closure member disposed in the passageway and contiguous to the sealing surface so as to generally preclude fuel flow through the seat orifice;

a magnetic actuator proximate the closure member that positions the closure member away from the sealing surface of the seat when energized so as to allow fuel flow through the passageway and past the closure member; and a metering disc proximate the seat so that a virtual projection of the sealing surface onto the metering disc defines a first virtual circle about the longitudinal axis, the metering disc including a second channel surface confronting the first channel surface so as to form a flow channel, the metering disc having at least two metering orifices being located about the longitudinal axis at substantially equal arcuate distance apart between adjacent metering orifices outside the first virtual circle, the at least two metering orifices include eight generally circular metering orifices generally concentric to the first virtual circle, each of the metering orifices extending generally parallel to the longitudinal axis between the second channel surface and an outer surface of the metering disc so that, when the magnetic actuator is energized to move the closure member, a flow of fuel through the metering orifices generates an unified spray pattern that intersects a virtual plane orthogonal to the longitudinal axis to define a flow area of generally uniform radii about the longitudinal axis on the virtual plane, wherein the metering disc comprises the outer surface being spaced from the second channel surface of the metering disc at a first thickness of at least 50 microns, and a first arcuate spacing comprises a linear distance between closest edges of adjacent metering orifices at least equal to approximately the first thickness.

5. The fuel injector of claim 4, wherein the first thickness of the metering disc comprises a thickness selected from a group comprising one of approximately 75, 100, 150, and 200 microns.

6. The fuel injector of claim 4, wherein the first thickness of the metering disc comprises a thickness of approximately 125 microns.

7. A fuel injector comprising:

a housing having a passageway extending between an inlet and an outlet along a longitudinal axis;

a seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface;

a closure member disposed in the passageway and contiguous to the sealing surface so as to generally preclude fuel flow through the seat orifice;

a magnetic actuator proximate the closure member that positions the closure member away from the sealing surface of the seat when energized so as to allow fuel flow through the passageway and past the closure member; and a metering disc proximate the seat so that a virtual projection of the sealing surface onto the metering disc defines a first virtual circle about the longitudinal axis, the metering disc including a second channel surface confronting the first channel surface so as to form a flow channel, the metering disc having at least two metering orifices being located about the longitudinal axis at substantially equal arcuate distance apart between adjacent metering orifices outside the first virtual circle, each of the metering orifices extending generally parallel to the longitudinal axis between the second channel surface and an outer surface of the metering disc so that, when the magnetic actuator is energized to move the closure member, a flow of fuel through the metering orifices generates an unified spray pattern that intersects a virtual plane orthogonal to the longitudinal axis to define a flow area of generally uniform radii about the longitudinal axis on the virtual plane, wherein the at least two metering orifices comprise an aspect ratio of the at least two metering orifices of between approximately 0.3 and 1.0, the aspect ratio being generally equal to approximately a length of each of the metering orifice between the second channel and outer surfaces of the metering disc divided by approximately the largest distance perpendicular to the longitudinal axis between any two diametrical inner surfaces of each of the metering orifices.

8. The fuel injector of claim 7, wherein the aspect ratio is inversely and generally related in a linear manner to an included angle of the single cone.

9. The fuel injector of claim 7, wherein first channel surface comprises an inner edge being located at approximately a first distance from the longitudinal axis and at approximately a first spacing along the longitudinal axis relative to the metering disc and an outer edge being located at approximately a second distance from the longitudinal axis and at approximately a second spacing from the metering disc along the longitudinal axis, such that a product of the first distance and first spacing is generally equal to a product of the second distance and second spacing.

10. The fuel injector of claim 7, wherein the projection of the sealing surface further converging at a virtual apex disposed within the metering disc, and the flow channel comprises a second portion extending from the first portion, the second portion having a constant sectional area as the flow channel extends along the longitudinal axis.

11. The fuel injector of claim 10, wherein the second distance is located at an intersection of a plane transverse to the longitudinal axis and the channel surface such that the intersection is at least 25 microns radially outward of the perimeter of a metering orifice.

12. The fuel injector of claim 7, wherein the flow area is located at least 50 millimeters from an outer surface of the metering disc along the longitudinal axis.

13. The fuel injector of claim 7, wherein the first portion of the flow channel comprises a generally frustoconical channel having a taper of about ten degrees with respect to a plane transverse to the longitudinal axis.

14. A method of generating a flow area having a plurality of uniform radii with a fuel injector, the fuel injector having a passageway extending between an inlet and outlet along a longitudinal axis, a seat and a metering disc proximate the outlet, the seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface to face towards the outlet, a closure member disposed in the passageway, a magnetic actuator proximate the closure member that positions the closure member, when energized, so as to allow fuel flow through the passageway and past the closure member through the seat orifice, the metering disc including at least two metering orifices, the method comprising:

locating all of the metering orifices outside of the first virtual circle so that adjacent metering orifices are spaced at substantially equal arcuate distances, the metering orifices extending generally parallel to the longitudinal axis through the second and outer surfaces of the metering disc; and flowing fuel past the oblique first channel surface that faces the outlet through the at least two metering orifices upon actuation of the fuel injector so that a fuel flow path intersecting a virtual plane orthogonal to the longitudinal axis defines a flow area of generally uniform radii about the longitudinal axis on the virtual plane.

15. The method of claim 14, wherein the flowing comprises generating at least two vortices disposed within a perimeter of each of the at least two metering orifices such that atomization of the flow path is enhanced outward of each of the at least two metering orifices.

16. A method of generating a flow area having a plurality of uniform radii with a fuel injector, the fuel injector having a passageway extending between an inlet and outlet along a longitudinal axis, a seat and a metering disc proximate the outlet, the seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface, a closure member disposed in the passageway, a magnetic actuator proximate the closure member that positions the closure member, when energized, so as to allow fuel flow through the passageway and past the closure member through the seat orifice, the metering disc including at least two metering orifices, the method comprising:

locating the metering orifices outside of the first virtual circle so that adjacent metering orifices are spaced at substantially equal arcuate distances, the metering orifices extending generally parallel to the longitudinal axis through the second and outer surfaces of the metering disc, the locating further comprises generating a generally unified spray pattern of the flow path along the longitudinal axis as a function of one of a first arcuate spacing and an aspect ratio of the at least two metering orifices, a size of the generally unified spray pattern being defined by an included angle of the outer perimeter of the generally unified spray pattern downstream of the fuel injector, and the aspect ratio being generally equal to approximately a length of each metering orifice between the second channel and outer surfaces of the metering disc divided by approximately the largest distance perpendicular to the longitudinal axis between any two diametrical inner surfaces of each metering orifice; and flowing fuel through the at least two metering orifices upon actuation of the fuel injector so that a fuel flow path intersecting a virtual plane orthogonal to the longitudinal axis defines a flow area of generally uniform radii about the longitudinal axis on the virtual plane.

17. The method of claim 16, wherein the generating comprises one of:

increasing a first arcuate spacing so as to decrease the included angle of the generally conical size of the spray pattern; and decreasing the first arcuate spacing so as to increase the included angle of the generally conical size of the spray pattern.

18. The method of claim 16, wherein the included angle comprises an angle between approximately 10 to 25 degrees, and a first arcuate spacing comprises a distance of at least approximately equal to the distance between the second and outer surfaces of the metering disc.

19. The method of claim 16, wherein the generating comprises changing the included angle by one of:

increasing the aspect ratio so as to decrease the included angle; and decreasing the aspect ratio so as to increase the included angle.

20. A method of generating a flow area having a plurality of uniform radii with a fuel injector, the fuel injector having a passageway extending between an inlet and outlet along a longitudinal axis, a seat and a metering disc proximate the outlet, the seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface, a closure member disposed in the passageway, a magnetic actuator proximate the closure member that positions the closure member, when energized, so as to allow fuel flow through the passageway and past the closure member through the seat orifice, the metering disc including at least two metering orifices, the method comprising:

locating the metering orifices outside of the first virtual circle so that adjacent metering orifices are spaced at substantially equal arcuate distances, the metering orifices extending generally parallel to the longitudinal axis through the second and outer surfaces of the metering disc;

flowing fuel through the at least two metering orifices upon actuation of the fuel injector so that a fuel flow path intersecting a virtual plane orthogonal to the longitudinal axis defines a flow area of generally uniform radii about the longitudinal axis on the virtual plane the flowing further comprises configuring the first channel surface between an inner edge at approximately a first distance from the longitudinal axis and at approximately a first spacing along the longitudinal axis relative to the metering disc and an outer edge at approximately a second distance from the longitudinal axis and at approximately a second spacing from the metering disc along the longitudinal axis, such that a product of the first distance and first spacing is generally equal to a product of the second distance and second spacing.

21. The method of claim 20, wherein the second distance is located at an intersection of a plane transverse to the longitudinal axis and the channel surface such that the intersection is at least 25 microns radially outward of the perimeter of a metering orifice.

22. A method of generating a flow area having a plurality of uniform radii with a fuel injector, the fuel injector having a passageway extending between an inlet and outlet along a longitudinal axis, a seat and a metering disc proximate the outlet, the seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface, a closure member disposed in the passageway, a magnetic actuator proximate the closure member that positions the closure member, when energized, so as to allow fuel flow through the passageway and past the closure member through the seat orifice, the metering disc including at least two metering orifices, the method comprising:

locating the metering orifices outside of the first virtual circle so that adjacent metering orifices are spaced at substantially equal arcuate distances, the metering orifices extending generally parallel to the longitudinal axis through the second and outer surfaces of the metering disc; and flowing fuel through the at least two metering orifices upon actuation of the fuel injector so that a fuel flow path intersecting a virtual plane orthogonal to the longitudinal axis defines a flow area of generally uniform radii about the longitudinal axis on the virtual plane, the flowing comprises distributing fuel substantially uniformly across the flow area on the virtual plane being located at least 50 millimeters from an outer surface of the metering disc along the longitudinal axis.

* * * * *